US006388196B1

(12) United States Patent
Liu et al.

(10) Patent No.: US 6,388,196 B1
(45) Date of Patent: May 14, 2002

(54) FAN WIRE COLLECTION STRUCTURE

(75) Inventors: Shu-fan Liu; Kuo-cheng Lin; Wen-shi Huang, all of Taoyan (TW)

(73) Assignee: Delta Electronics, Inc., Taoyan Shien (TW)

( * ) Notice: Subject to any disclaimer, the term of this patent is extended or adjusted under 35 U.S.C. 154(b) by 0 days.

(21) Appl. No.: 09/502,408

(22) Filed: Feb. 10, 2000

(30) Foreign Application Priority Data

Oct. 20, 1999 (TW) ..... 088217934

(51) Int. Cl.[7] ..... H01B 7/00
(52) U.S. Cl. ..... 174/135; 174/72 A; 24/129 R
(58) Field of Search ..... 174/70 A, 71 R, 174/72 A, 72 C, 72 TR, 73.1, 135, 136, 138 G, 168, 175; 24/115 F, 115 H, 115 M, 129 R; 191/28

(56) References Cited

U.S. PATENT DOCUMENTS 593,689 A * 11/1897 Rembe ..... 24/129 R
887,520 A * 5/1908 Rehling ..... 24/129 R
1,531,746 A * 3/1925 Fort ..... 24/129 R
2,479,312 A * 8/1949 Churchill ..... 24/129 R
4,162,561 A * 7/1979 Tillemans ..... 24/129 R
4,178,057 A * 12/1979 McCormick ..... 174/135
4,224,465 A * 9/1980 Ruzic ..... 174/135
5,563,378 A * 10/1996 Uchida et al. ..... 174/135
5,949,167 A * 9/1999 Blalock et al. ..... 174/65 R
5,952,616 A * 9/1999 Morrow ..... 174/135
5,996,944 A * 12/1999 Daoud ..... 174/135
6,094,783 A * 8/2000 Parsons ..... 24/129 R
6,229,090 B1 * 5/2001 Kawaguchi et al. ..... 174/72 A

* cited by examiner

*Primary Examiner*—Dean A. Reichard
*Assistant Examiner*—Adolfo Nino

(57) ABSTRACT

A fan wire collection structure includes a base, a rise portion formed on the base, at least one flank supports each connecting to one side of the base, and at least one stop boards each connecting to one of the flank supports integrally, wherein wires are twisted in a space defined by the base, the rise portion, the at least one flank supports, and the at least one stop boards.

2 Claims, 4 Drawing Sheets

FAN WIRE COLLECTION STRUCTURE

BACKGROUND OF THE INVENTION

1. Field of Invention

The present invention generally relates to a simple fan wire collection structure and, more particularly, to a fan wire collection structure that utilizes a devious structure to fix and protect the wires.

2. Related Art

The power supply wires of a heat dissipation fan used in the computer system are connected to the exterior via a wire collection structure. The wire collection structure is mainly formed on a fan rib, which has the functions of fixing and protecting the power supply wires so that the wires will not get loose or engulfed into the fan due to the vibration and air flow of the running fan. Also, when assembling the computer system, the power supply wires will not be pulled off from the soldering point on the fan motor.

FIGS. 3A and 3B are schematic views of a conventional fan wire collection structure 30, wherein FIG. 3A is a top view while FIG. 3B a three dimensional diagram. Referring to FIG. 3A, the fan wire collection structure 30 in the prior art is a wire passage structure formed by a base 31 and two flank supports 32. The wires 80 extending from the fan are first placed between the base 31 and the two flank supports 32, then connect to the exterior. This is the simplest conventional wire collection structure. Its drawback is that the wires 80 can not be firmly fixed within the wire collection structure 30 so that the wires 80 can be easily tilted and exposed outside the wire collection structure 30. This makes the wire collection structure 30 lack of the wire protection function. In addition, this wire collection structure 30 has a weak resistance to external forces, therefore, when the wires 80 are dragged by an external force, they can be easily pulled off from the soldering point and cause the damage to the fan.

FIGS. 4A and 4B are schematic views of another conventional improved fan wire collection structure 40, wherein FIG. 4A is a top view while FIG. 4B a three dimensional diagram. Referring to FIG. 4A, the fan wire collection structure 40 in the prior art is a wire passage structure formed by a base 41, two flank supports 42, and two stop boards 43. The main difference between the current structure and the previous structure in FIG. 3 is that stops boards are formed above the passage structure, which prevent the tilt and thus the exposure of the wires 80 from the wire collection structure 40. The wire collection structure 40 enhances the fixing effect for the wires 80, however, it still lacks of the protection from the external force pulling on the wires 80.

FIGS. 5A and 5B are schematic views of another conventional improved fan wire collection structure 50, wherein FIG. 5A is a top view while FIG. 5B a three dimensional diagram. Referring to FIG. 5A, the fan wire collection structure 50 in the prior art is a wire passage structure formed by a base 51, two flank supports 52, and two stop boards 53. The main difference between the current structure and the previous structure in FIG. 4 is that a clipping force is applied on the wires 80 within the wire collection structure 50. After the wires 80 extend outside the fan, a wire clip 54 for clipping the wires 80 is inserted into the wire passage structure from above to clip the wires 80 so as to strengthen the resistance of the wire collection structure 50 to the external force. Nevertheless, since the wire clip 54 and the wire collection structure 50 are not formed integrally but two separate elements, it results in extra time for assembling, and increases the cost for materials, manufacturing, and further processing.

SUMMARY OF THE INVENTION

The object of the present invention is to provide a simple fan wire collection structure which has a good fixing function on the wires so that the wires will not tilt.

Another object of the present invention is to provide a simple fan wire collection structure which has a stronger resistance to the external pulling force on the wires.

Yet another object of the present invention is to provide a simple fan wire collection structure, which is formed integrally to reduce the cost for materials, further manufacturing and assembling.

To achieve the above object, the fan wire collection structure according to the instant invention includes a base, a rise portion formed on the base, at least one flank supports each connecting to one side of the base, and at least one stop boards each connecting to one of the flank supports integrally, wherein wires are twisted in a space defined by the base, the rise portion, the at least one flank supports, and the at least one stop boards.

The above structure can firmly fix the wires without tilting and has a stronger resistance to the external pulling force on the wires. In addition, the structure is formed integrally and does not need additional elements, therefore it can greatly reduce the cost for materials, further manufacturing and assembling.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein:

FIGS. 1A through 1C are schematic views of a fan wire collection structure according to the invention, wherein FIG. 1A is a top view of the whole fan, FIG. 1B a top view of the fan wire collection structure, and FIG. 1C a three dimensional diagram of the wire collection structure.

FIGS. 2A and 2B are schematic views of another fan wire collection structure according to the invention, wherein FIG. 2A is a top view while FIG. 2B a three dimensional diagram.

FIGS. 3A and 3B are schematic views of a conventional fan wire collection structure, wherein FIG. 3A is a top view while FIG. 3B a three dimensional diagram.

FIGS. 4A and 4B are schematic views of another conventional improved fan wire collection structure, wherein FIG. 4A is a top view while FIG. 4B a three dimensional diagram.

FIGS. 5A and 5B are schematic views of another conventional improved fan wire collection structure, wherein FIG. 5A is a top view while FIG. 5B a three dimensional diagram.

DETAILED DESCRIPTION OF THE INVENTION

Figure 1A:
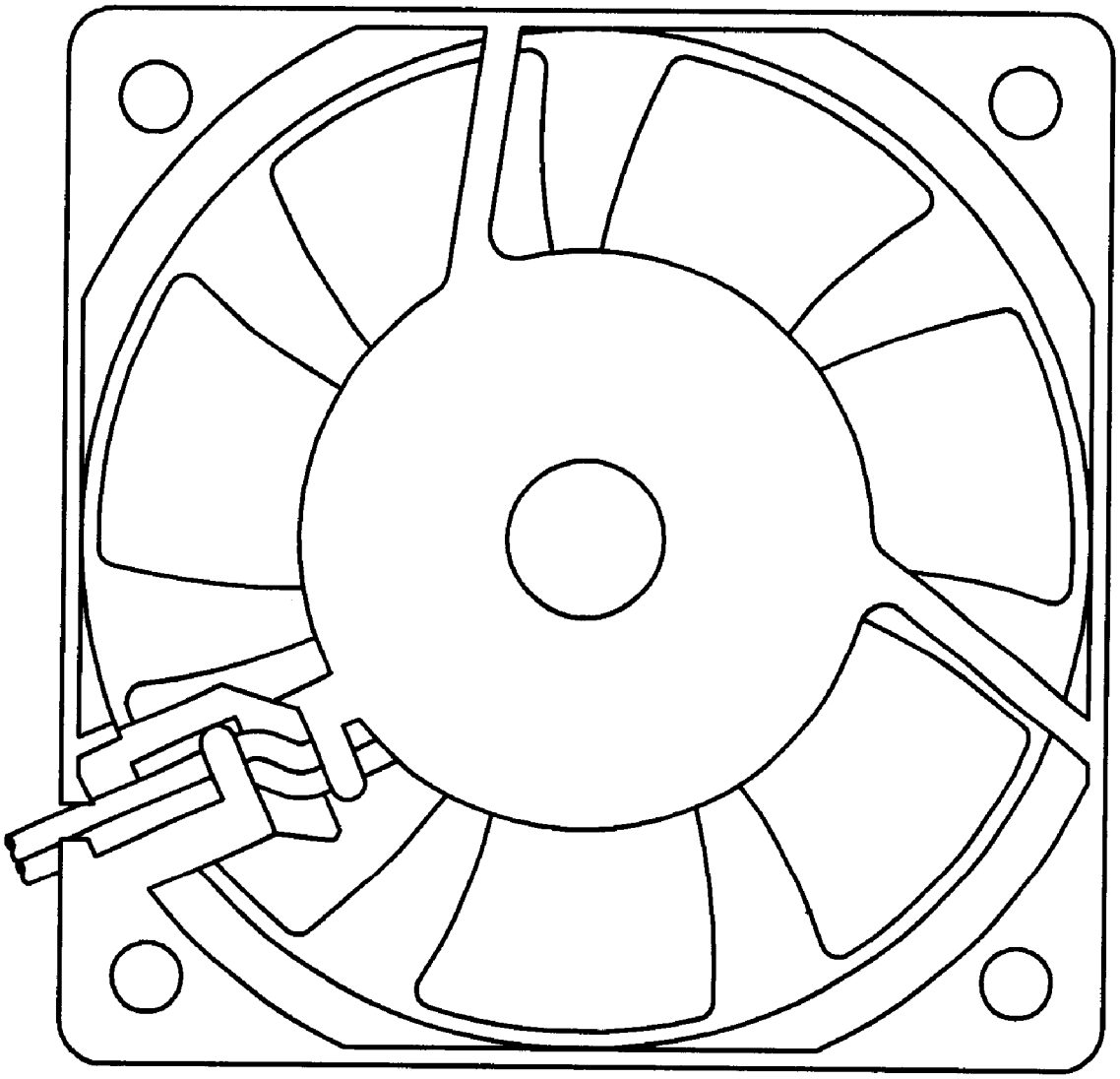
Figure 1B:
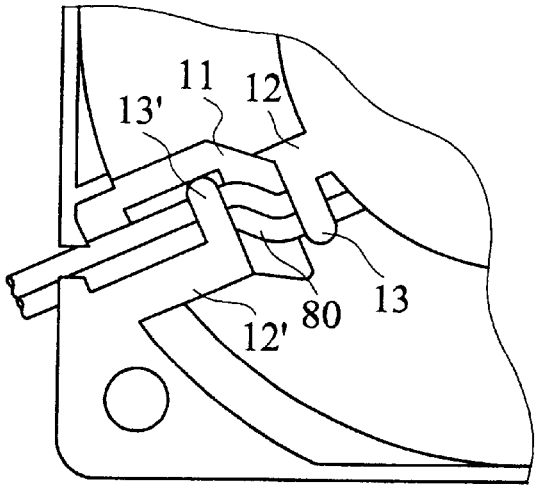
Figure 1C:
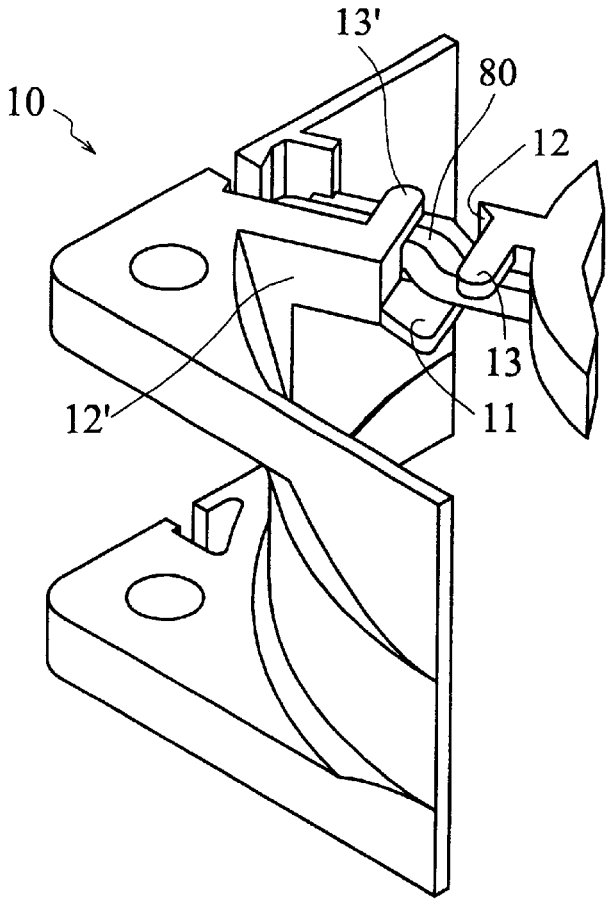

Referring to FIG. 1B, the fan wire collection structure 10 according to the instant invention includes a base 11, two flank supports 12, 12' perpendicular to both sides of the base 11, and two stop boards 13, 13' positioned above the base 11 with each perpendicularly connecting to one of the flank supports 12, 12', respectively.

The base 11 of the wire collection structure 10, the two flank supports 12, 12' and the two stop boards 13, 13' form a channel. The wires connecting from the fan motor enter this channel. From the relative positions shown in FIG. 1B, the lower right side of the upper right flank support 12 (namely, the side in contact with the wires 80) and the upper left corner of the lower left flank support 12' (namely, the side in contact with the wires 80) are parallel to each other. The span between the parallel supports 12 and 12' is slightly smaller than the sum of the diameters of the wires 80, therefore the wires 80 will be slightly twisted between the flank supports 12 and 12'. Since the wires 90 are placed within the wire collection structure 10 in a twisted state, but not in a straight line as in the wire collection structure of the prior art, the flank supports 12 and 12' of the wire collection structure 10 will have action forces with the wires 80, including a normal force and a frictional force. These forces are generated by the restoration force of the wires 80 under the twisted state. Owing to the existence of these forces, the wires 80 fixed more firmly within the wire collection structure 10. When the wires 80 are dragged under the external forces, these action forces can pull against the external dragging forces. Compared with the conventional wire collection structure, the wire collection structure 10 of the invention has better fixing and protection effects on the wires 80. Thus, when the fan is running, the wires 80 will not get loose or engulfed into the fan due to the vibration or air flow. Also when assembling the computers, the wires 80 will not be easily pulled off from the soldering point on the fan motor.

The function of the stop boards 13, 13' is to prevent the wires from extruding out from the above of the wire collection structure 10. However, since a frictional force exists between the flank supports 12, 12' and the wires 80, if a proper geometrical size is carefully chosen, the wires 80 in fact will not shift relatively to the flank supports 12, 12'. Thus, the wires 80 may not touch the stop boards 13, 13'; in other words, the function of the step boards 13, 13' in this embodiment is not to cause devious wiring as the flank supports 12 and 12' does, but just to ensure that the wires 80 can be more firmly fixed within the wire collection structure 10. If the devious wires 80 are twisted so much that the frictional force between the wires 80 and the flank supports 12, 12' is large, then one or both of the stop boards 13, 13' can be removed without any influence on the wire collection structure 10.

By changing the geometrical size of the wire collection structure, the devious twist condition of the wires in the wire collection structure can be adjusted to further determine the action forces between the wires and the wire collection structure. Theoretically, the larger the action forces are, the better the fixing and protection effects for the wires the wire collection structure has. Nevertheless, too much devious twist may result in uneasy assembly or even damage the wires. Therefore, a proper geometrical size has to be chosen so that the relative positions of the flank supports and stop boards of the wire collection structure can have the best fixing and protection for the wires without damaging the wires or the fan.

Since the wires 80 are placed within the wire collection structure 10 in a slightly devious way and naturally generate action forces, no additional elements are needed to fix the wires. So the wire collection structure 10 can be formed integrally. This can greatly reduce the cost for materials, further manufacturing and assembling.

Figure 2A:
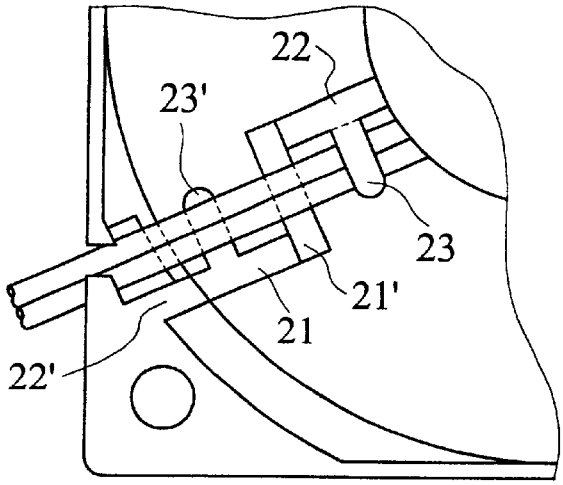
Figure 2B:
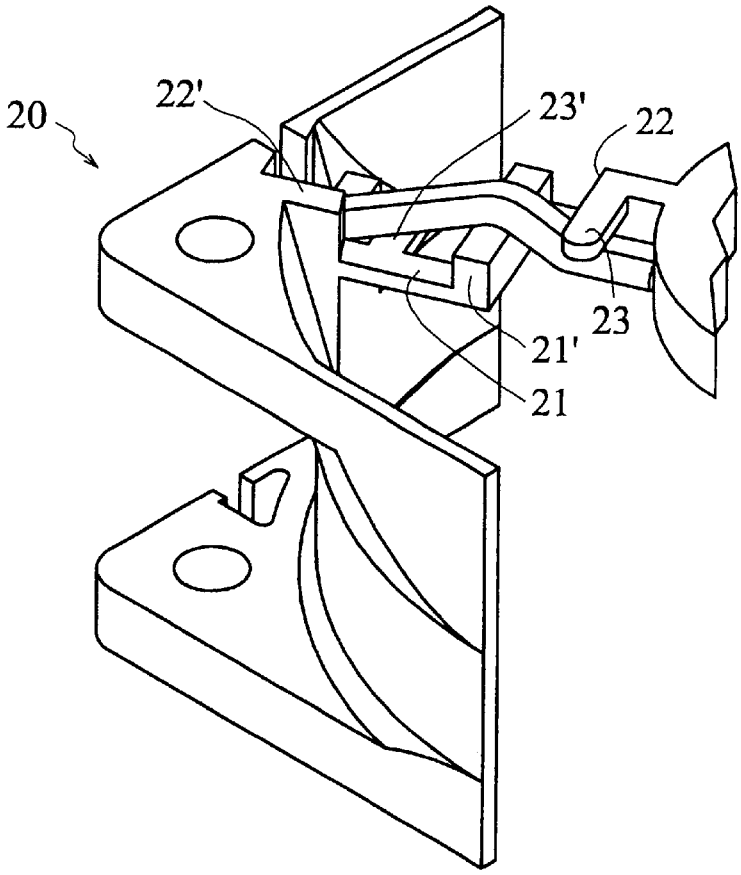
Figure 3A:
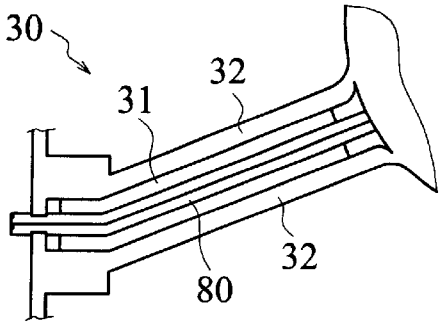
FIG. 3(A) (PRIOR ART)
Figure 3B:
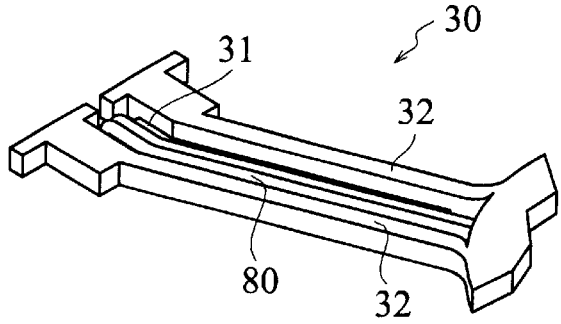
FIG. 3(B) (PRIOR ART)
Figure 4A:
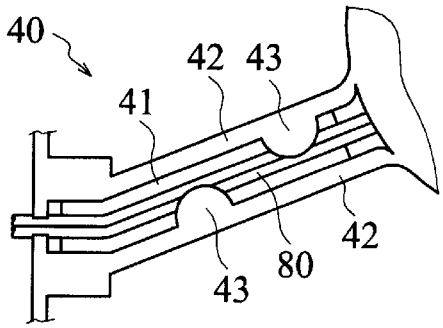
FIG. 4(A) (PRIOR ART)
Figure 4B:
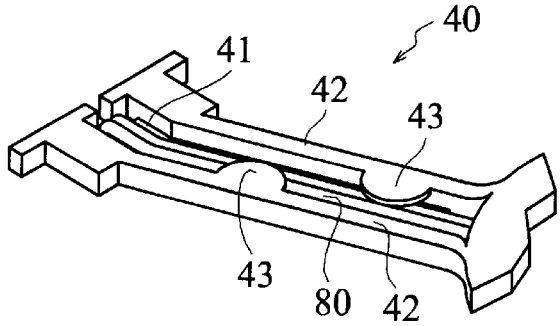
FIG. 4(B) (PRIOR ART)
Figure 5A:
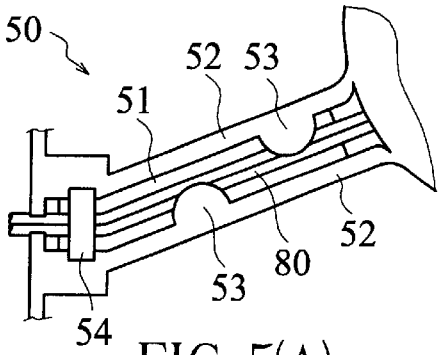
FIG. 5(A) (PRIOR ART)
Figure 5B:
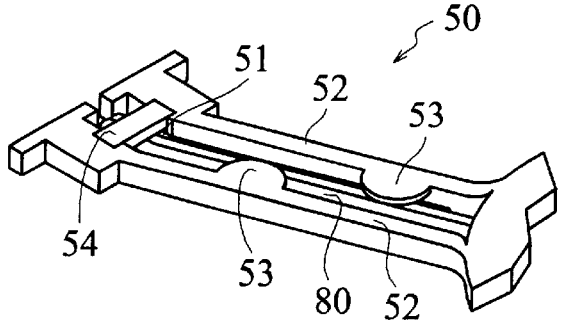
FIG. 5(B) (PRIOR ART)

FIGS. 2A and 2C are schematic views of a fan wire collection structure according to the second embodiment of the invention, wherein FIG. 2A is a top view, and FIG. 2B a three dimensional diagram of the wire collection structure. Referring to FIG. 1B, the fan wire collection structure 20 according to the instant invention comprises:

a base 21;

two flank supports 22, 22' perpendicular to both sides of the base 21; and two stop boards 23, 23' positioned above the base 21 with each of which perpendicularly connecting to one of the flank supports 22, 22', respectively.

The main difference between the wire collection structure 20 and the previous wire collection structure 10 is that the contact surface between the base 21 and the wires 80 is not a plane, but includes a rise portion 21'. Referring to FIG. 2B, Since the span between the contact surface between the stop boards 23 and 23' and the wires 80 and that between the rise portion 21' of the base 21 and the wires 80 is smaller than the diameter of the wires 80, the wires 80 will be twisted within the wire collection structure 20. This twisted state has the same effect as that in the previous wire collection structure 10. The wires 80 under a twisted state naturally generate a restoration force so that the wires 80 can be more firmly fixed within the wire collection structure 20. When the wires 80 are dragged by external forces, this restoration force then resists the dragging force. Compared with the conventional wire collection structure, the wire collection structure 20 of the invention has better fixing and protection effects on the wires 80. Thus, when the fan is running, the wires 80 will not get loose or engulfed into the fan due to the vibration or air flow. Also when assembling the computers, the wires 80 will not be easily pulled off the soldering point on the fan motor.

Similar to the above mentioned first embodiment, if a proper geometrical size is chosen, the wires 80 will not be easily sideward shifted relative to the stop boards 23 and 23'. Thus, the wires 80 may not touch the flank supports 22 and 22'; in other words, the function of the flank supports 22 and 22' in this embodiment is not to cause devious wiring as the flank supports 12 and 12' does, but just to ensure that the wires 80 can be more firmly fixed within the wire collection structure 20. If the devious wires 80 are twisted so much that the frictional force between the wires 80 and the stop boards 23, 23' is large, then one or both of the flank supports 22, 22' can be removed without any influence on the wire collection structure 20.

Since the wires 80 are placed within the wire collection structure 20 in a slightly devious way and naturally generate action forces, so, just like the previous wire collection structure 10, no additional elements are needed to fix the wires 80. So the wire collection structure 20 can be formed into a single body. This can greatly reduce the cost for materials, further manufacturing and assembling.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wire collection structure for fixing and protecting wires, comprising:

a base;

a rise portion formed on said base;

at least one flank supports, each connecting to one side of said base; and at least one stop boards, each connecting to one of said flank supports integrally, wherein wires are twisted in a space defined by said base, said rise portion, said at least one flank supports, and said at least one stop boards.

2. A wire collection structure installed on a fan main body for fixing and protecting wires connecting from said fan main body to the exterior, comprising:

a base;

a rise portion formed on said base;

at least one flank supports, each connecting to one side of said base; and at least one stop boards, each connecting to one of said flank supports integrally;

wherein wires are twisted in a space defined by said base, said rise portion, said at least one flank supports, and said at least one stop boards.

* * * * *